US006676585B1

(12) United States Patent
Stahlecker et al.

(10) Patent No.: US 6,676,585 B1
(45) **Date of Patent: *Jan. 13, 2004**

(54) ARRANGEMENT UTILIZING STAR WHEELS AND MATERIAL SUPPLY STATIONS FOR MANUFACTURING A PAPER CAN

(75) Inventors: Werner Stahlecker, Goeppingen (DE); Berthold Mueller, Suessen (DE)

(73) Assignee: Michael Hoerauf Maschinenfabrik GmbH & Co. KG, Donzdorff (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 45 days.

(21) Appl. No.: 09/086,286

(22) Filed: May 29, 1998

(30) Foreign Application Priority Data

Jun. 20, 1997 (DE) ..... 197 26 215

(51) Int. Cl.[7] ..... B31B 1/84

(52) U.S. Cl. ..... 493/87; 493/102; 493/105; 493/108; 493/110; 493/117; 493/134; 53/234; 53/576

(58) Field of Search ..... 493/87, 102, 104, 493/105, 108, 110, 116, 117, 133, 134; 53/576, 579, 234

(56) References Cited

U.S. PATENT DOCUMENTS

| | | | | | |
|---|---|---|---|---|---|
| 3,382,775 | A | * | 5/1968 | Allen | 493/135 |
| 3,563,000 | A | * | 2/1971 | Whitehouse et al. | 53/579 |
| 3,961,566 | A | * | 6/1976 | Westphal et al. | 493/104 |
| 3,990,353 | A | * | 11/1976 | Richards et al. | 493/108 |
| 4,490,130 | A | | 12/1984 | Konzal et al. | |
| 4,842,681 | A | * | 6/1989 | Bader et al. | 242/555.3 |
| 5,135,462 | A | | 8/1992 | Stahlecker et al. | |
| 5,302,167 | A | * | 4/1994 | Kley et al. | 493/400 |
| 5,678,385 | A | * | 10/1997 | Focke et al. | 53/148 |
| 5,849,123 | A | * | 12/1998 | Rice | 242/555.1 |
| 5,943,840 | A | * | 8/1999 | Nilsson et al. | 493/105 |

* cited by examiner

*Primary Examiner*—Eugene Kim
*Assistant Examiner*—Christopher Harmon
(74) *Attorney, Agent, or Firm*—Crowell & Moring LLP

(57) ABSTRACT

An arrangement for manufacturing a paper can includes processing stations arranged one behind the other along two star-shaped wheels. Packaging material from supply stores is fed to each star-shaped wheel. The two star-shaped wheels and the processing stations arranged thereto are disposed on the same machine frame. The packaging material for both star-shaped wheels are fed from a joint material supply station. Thereby, a compact construction and reduced operational procedure are achieved.

16 Claims, 6 Drawing Sheets

ARRANGEMENT UTILIZING STAR WHEELS AND MATERIAL SUPPLY STATIONS FOR MANUFACTURING A PAPER CAN

BACKGROUND AND SUMMARY OF THE INVENTION

This application claims the priority of German application 197 26 215.5, filed Jun. 20, 1997, the disclosure of which is expressly incorporated by reference herein.

The present invention relates to an arrangement for manufacturing a paper can from blanks of packing material, comprising processing stations which are arranged one behind the other along a first star wheel and a second star wheel. The stations are rotatable in a cyclical motion and comprise holding devices for the blanks which can be fed to the processing stations one after the other to be put together and formed one by one. Material supply stations hold ready packing material to be processed, and feeding devices feed the packing material to each star wheel.

Paper cans, manufactured by known arrangements, consist in their finished state of a tube, on both open front sides of which a front wall is arranged. Paper cans of this type are filled after their completion, that is after the second front wall has been applied. They have for this purpose on one front wall a filling opening, which can be sealed after filling. The filling opening may also be used by the consumer as an emptying opening.

Paper cans of this type are put together using a plurality of blanks, usually three, which are at first in the form of sheets. During manufacture, these sheet-like blanks are formed into the tube or the front walls and put together as a paper can. The forming and putting together of the blanks occurs in stages in consecutive processing stations. To make a paper can, a blank is transported from processing station to processing station, whereby in subsequent processing stations further blanks required for the paper can are fed thereto. The blanks are formed and joined together in the processing stations, whereby as a rule, in each subsequent processing station a further production stage is reached.

The paper used as packing material is such that it can be provided with one or more layers of plastic. Different packing material may be used for the various blanks of a paper can. Therefore, it is conventional that the packing material for the different blanks of a paper can are each fed separately. The feed material comes in large units, for example in the form of rolled up tapes of material or stacks of blanks. In the case of material tapes, blanks in the desired form are punched out of them. In arrangements for manufacturing a paper can, the packing material is usually kept on hand in material supply stations.

One such arrangement is described in U.S. Pat. No. 5,135,462 in which two separate arrangements are joined together. Each separate arrangement is arranged to its own machine frame and comprises a star wheel with processing stations arranged thereto. The star wheels are each fed packing material from separate material supply stores. Both machine frames are connected together by a transport device. Partly completed paper cans are transported in a random stream by this transport device from the first separate arrangement to the second separate arrangement. There the paper cans are separated and processed to complete cans.

British Patent No. 704 608 discloses a further arrangement for manufacturing paper cans. This arrangement comprises a plurality of consecutively arranged processing stations, at which the paper cans are put together in stages.

The processing stations are distributed over a plurality of machine frames which are connected together by transport devices. The packing material is fed from separate material supply stores. The arrangement takes up a large amount of floor space and has a very complicated design.

U.S. Pat. No. 4,490,130 discloses a machine for manufacturing paper cups which are produced from a blank for a sleeve and a blank for a bottom. The blanks for the sleeve are fed to a first star wheel and the blanks for the bottom are fed to a second star wheel. Two separate material supply stores are provided for the packing material, which stores are arranged far away from each other. As the paper cup has a relatively simple form and comprises of only two pieces, the forming and the putting together takes place only in the area of the second star wheel. It is thus possible to arrange the star wheels to a joint machine frame.

An object of the present invention is to simplify the arrangement for manufacturing paper cans.

This object has been achieved in accordance with the present invention by providing that the two star wheels and the respective work stations are arranged on a joint machine frame, to which a joint material supply station for packing material comprising various blanks is arranged.

The simplified configuration obtained the present invention results in a series of advantages.

The arrangement of the star wheels according to the present invention does away with the need for complicated transport devices, as well as alignment at the end of the transporting device, which was necessary up to now. Partly completed paper containers can be transported from the first star wheel to the second star wheel in a simple way. The transporting device between the two star wheels can be of a corresponding configuration. In addition, floor space is reduced, as only one machine frame is necessary. Both the star wheels can be driven by a joint drive in a simple design. A joint drive can also be used for most of the parts of the processing stations.

The joint material supply station for different types of packing material leads to the substantial advantage that the material feed is simplified overall. A good basis for automation of the material is thereby achieved. Even without automation, the operational stages necessary for the material supply and the material feed are considerably reduced.

The present invention makes manufacture of a complete paper can in a compact installation possible, which paper can is made up of a plurality of blanks and has no inner open paper cut edges. The paper can comprises a filling opening which can be closed by an appropriate closing element. Covering strips, stoppers or such similar elements can be used as closing elements. The closing element can be applied before filling, namely in such a way that the filling opening is not yet covered before filling, or that it can be opened again without destroying the closing element.

The filling opening and the closing element can be so configured that the filling opening can also be used as an emptying opening. In this case, it is practical when the closing element is affixed in such a way that the emptying opening still looks presentable after the consumer has removed the closing element.

The present invention also contemplates configuration of the paper can so that the consumer can create the emptying opening, for example, along a weakened line. Another contemplated approach is to provide an emptying opening in the paper can in addition to the filling opening. The emptying opening is closed by a closing element. The filling opening is then not used as an emptying opening.

The packing material for the blanks, from which the paper can is put together, is centrally fed in the installation. Of course, the packing material can fed separately for all the various blanks or other elements necessary for the manufacture of the paper can and process in the installation. The packing material can also be fed in such a way that blanks, or other elements of the paper can which belong together, are already connected. For example, for the blanks which later form the walls of the paper can, packing material can be fed which already is provided with a protected edge or with a closing element.

In one advantageous embodiment of the present invention, a plurality of holders for holding each one roll of packing material are provided at the joint material supply station. It is hereby practical when reserve rolls are arranged to the holders, thereby making advantageous when a connecting device for adhering the end of one roll with the start of a reserve roll is arranged to the material supply station. A connecting device of this type can be so configured that it can be applied to rolls of varying widths. The above mentioned measures result in a simplified construction and in particular in a reduction of operational stages.

Another advantage of the present invention arises when the material supply station comprises one holder for a roll of packing material for a sleeve, one holder for a roll of packing material for a bottom and one holder for a roll of packing material for a lid of a paper can to be manufactured.

In an advantageous embodiment the material supply station comprises a holder for a roll of packing material for a pull tab, which functions as a closing element for a filling opening of the paper can to be manufactured. The paper can, with all its component pieces, is manufacturable in a single arrangement. As already mentioned above, the pull tab can be applied in such a away that the filling opening is not yet covered. The pull tab then needs only to be sealed in a filling machine which may be arranged downstream of the installation. As already mentioned above, the pull tab can instead be already provided in the fed packing material for the walls of the paper can.

In a corresponding way, a roll of packing material for a pull tab can be fed, which serves as a closing element for an emptying opening. This pull tab can be applied by the arrangement of the present invention so that it seals closed the emptying opening. As already mentioned above, the pull tab can be already provided in the fed packing material for the wall of the paper can.

In an advantageous embodiment of the present invention, two star wheels are arranged in relation to the joint machine frame that they are disposed adjacent one another and their rotational axles extend horizontally. The configuration can thereby be further simplified and allows both the star wheels and the respective processing stations being easily accessible from one side, for example for the purpose of changing tools or for maintenance work. The drive and gear elements can be taken up in the area of the back side and are also easily accessible.

In the present invention, a transport device is provided, by way of which a partly completed paper can is transportable in a linear movement from the first star wheel to the second star wheel. The star wheels are advantageously arranged such that in the area of the transport device a mounting device of the first star wheel is disposed opposite a mounting device of the second star wheel. Thereby, the transfer of a partly completed paper can from the first star wheel to the second star wheel can be effected in a simple way.

A processing station for forming a sleeve, a processing station for applying a lid comprising a filling opening and a processing station for localized partial fixing of a pull tab on the packing material for the lid are arranged to the first star wheel, in accordance with the present invention, whereas a processing station for applying a bottom is arranged to the second star wheel. Thereby, a paper can comprising a pull tab is manufacturable in a simple way. As the pull tab is only partially locally fixed, the filling opening can be easily uncovered by removing the pull tab.

Another advantage of the present invention arises when a processing station for removing the pull tab from the filling opening is arranged to the first star wheel. The processing station is arranged downstream of the processing station for localized partial fixing of the pull tab. The partly completed paper can is thus be transferable to the second star wheel with an uncovered filling opening. A machine tool is insertable into the filling opening in order to facilitate the application of the bottom.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
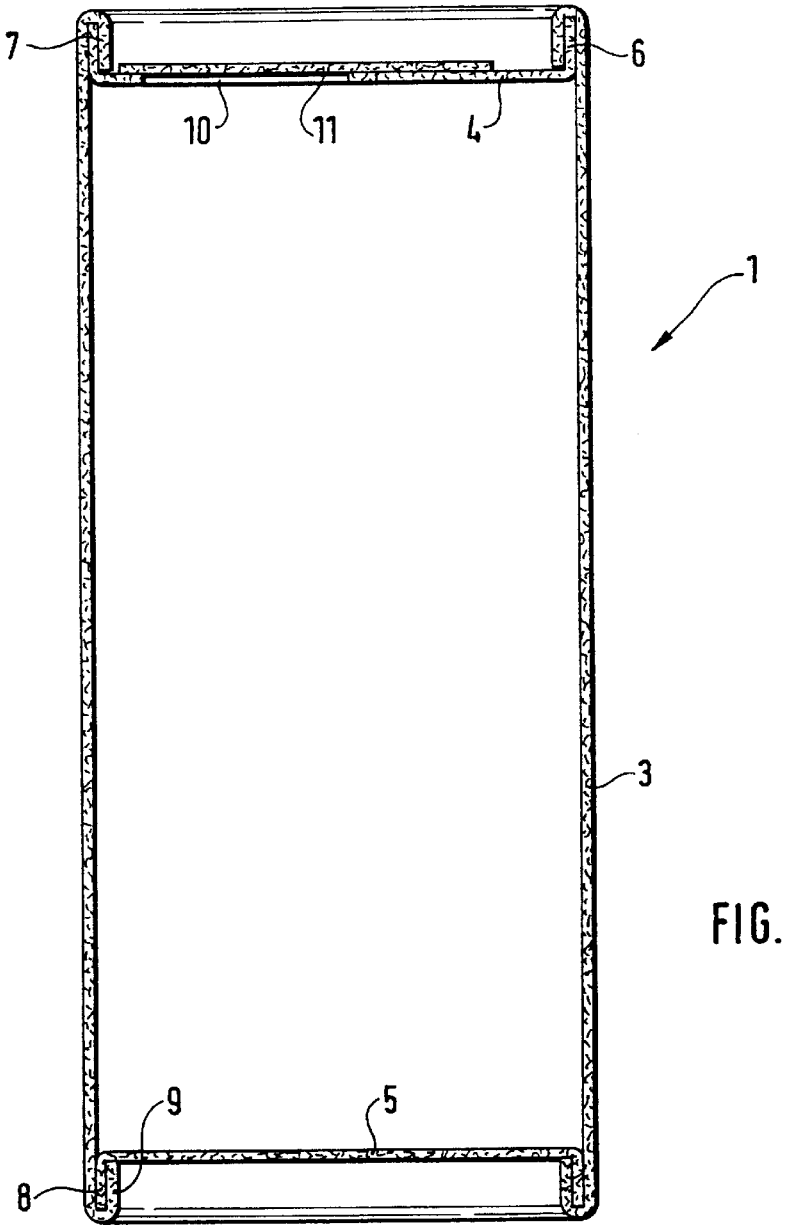
FIG. 1 is a cross-sectional, elevational view of a paper can in a closed state manufactured according to the present invention.
Figure 14:
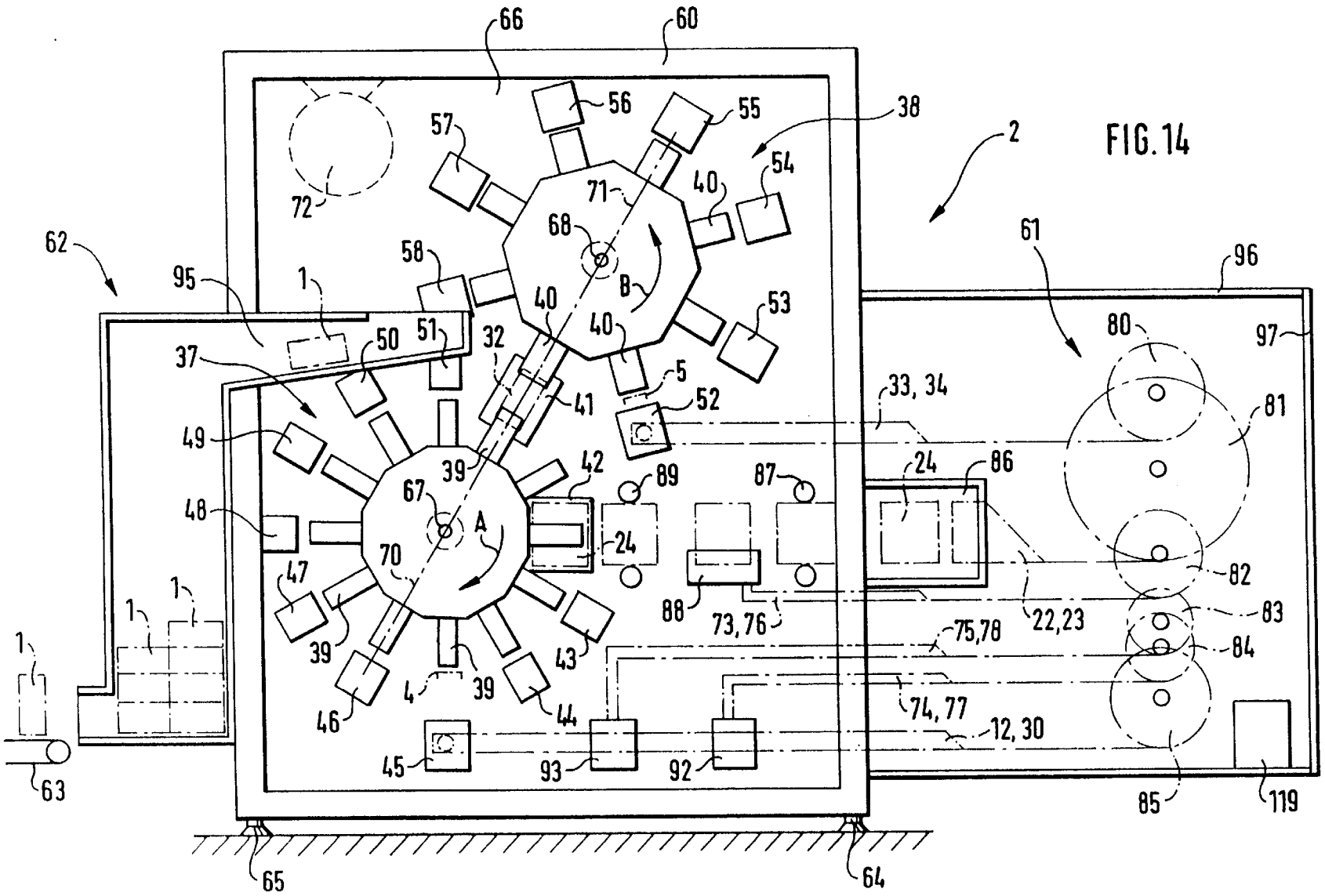
FIG. 14 is an arrangement for manufacturing a paper can in accordance with the present invention.

An embodiment of a paper can 1 is shown in FIG. 1 which is manufacturable by the arrangement 2 shown in FIG. 14. The paper can 1 comprises a sleeve 3 and two front walls which are inserted into the sleeve 3 and adhered in a sealed way thereto by heat sealing. The front wall serving as a lid 4 comprises a rim 6, around which the end area 7 of the sleeve 3 is rolled. Thus, a seam area is formed in this area which is sealed closed after heat sealing. Correspondingly, the bottom 5 comprises a rim 8, around which the end area 9 of the sleeve 3 is rolled. A seam area is formed also on the bottom 5 and is sealed closed by heat sealing.

The lid 4 comprises a filling opening 10 which can be closed by a pull tab 11. In the position shown in FIG. 1, the pull tab 11 is disposed over the filling opening 10, thus sealing it so that the paper can 1 is closed. The filling opening 10 can be uncovered by pulling off the pull tab 11 so as to serve as an emptying opening. As can be seen from FIG. 2, packing material 12 is used for the lid 4 and comprises a paper layer 13, an inner plastic layer 14 and an outer plastic layer 15. Both plastic layers 14, 15 are heat sealable.

A cut edge 16 of the lid 4 which forms the peripheral edge of the filling opening 10 is covered by an edge protector which takes the form of a rivet-like sealing lip 17. The sealing lip 17 is adhered to the lid 4 in a suitable way, for example by heat sealing.

The pull tab 11 comprises, on its side facing the filling opening 10, a layer of heat sealable plastic (not shown). The plastic layer of the pull tab 11 is adhered in a sealed way to the outer plastic layer 15 of the lid 4 along a heat seal seam 18. The pull tab 11 is also affixed to the lid 4 at a fixing point 19 as described below.

The paper can 1 comprises essentially a sleeve 3, a lid 4 and a bottom 5. The lid 4 (see also FIG. 9) and the bottom 5 (see also FIG. 13) are both in their completed forms before they are put into the sleeve 3. The sleeve 3 has the form of a tube 21 (see also FIG. 6) before assembly, whereas both end areas 7, 9 are not yet rolled in. For the manufacture of the sleeve 3 (see also FIG. 1), packing material 22 (see also FIG. 3) is used, and has the same or a similar composition as the packing material 12 (see also FIG. 2) of the lid 4.

Figure 3:
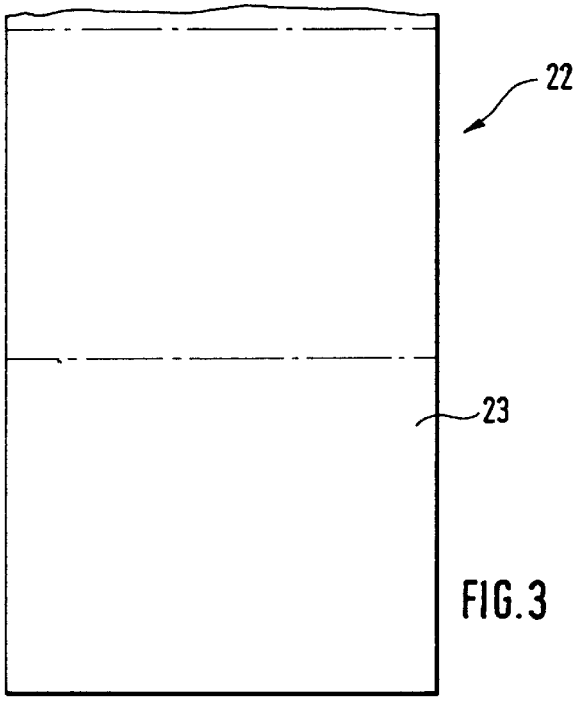
FIG. 3 is a tape of packing material for making blanks for the sleeve of the paper can of FIG. 1.
Figure 4:
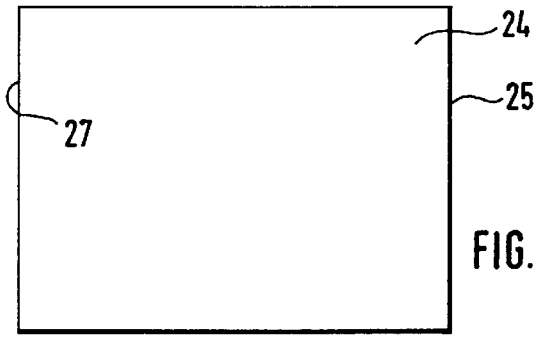
FIG. 4 is a blank for the sleeve of the paper can separated from the tape of FIG. 3.
Figure 5:
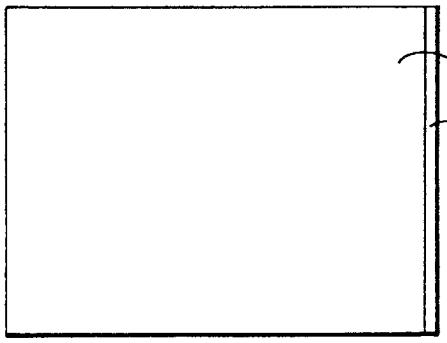
FIG. 5 is the blank of FIG. 4 comprising a sealing strip serving as an edge protector.

As can be seen from FIG. 3, the packing material 22 is fed as a tape 23, from which blanks 24 (see also FIG. 4) are separated off. The separation lines are denoted in FIG. 3 by a dot-dash line. The blank 24 is provided on a longitudinal edge 25 with an edge protector which takes the form of a sealing strip 26 made of plastic (see also FIG. 5). The opposite longitudinal edge 27 is not covered by a sealing strip.

Figure 6:
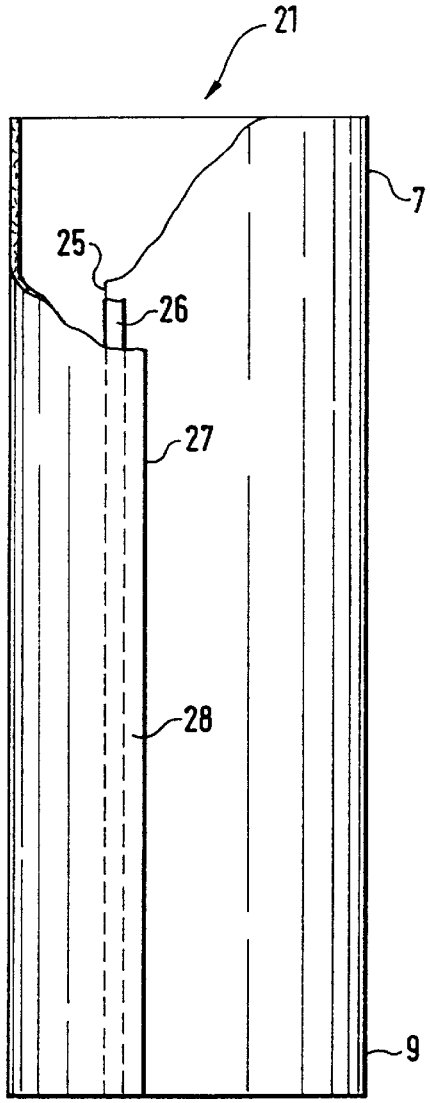
FIG. 6 is the blank of FIG. 5 formed into a tube.

The blank 24 provided with the sealing strip 26 is now formed into the tube 21 as shown in FIG. 6, whereby the two longitudinal ends of the blank 24 overlap each other. The longitudinal edge 25 provided with the sealing strip 26 is disposed on the inside of the tube 21, whereas the longitudinal edge 27 is disposed on the outside. The two overlapping longitudinal ends of the blank 24 are adhered to one another, preferably by heat sealing so that a closely sealed seam area 28 is formed.

Figure 7:
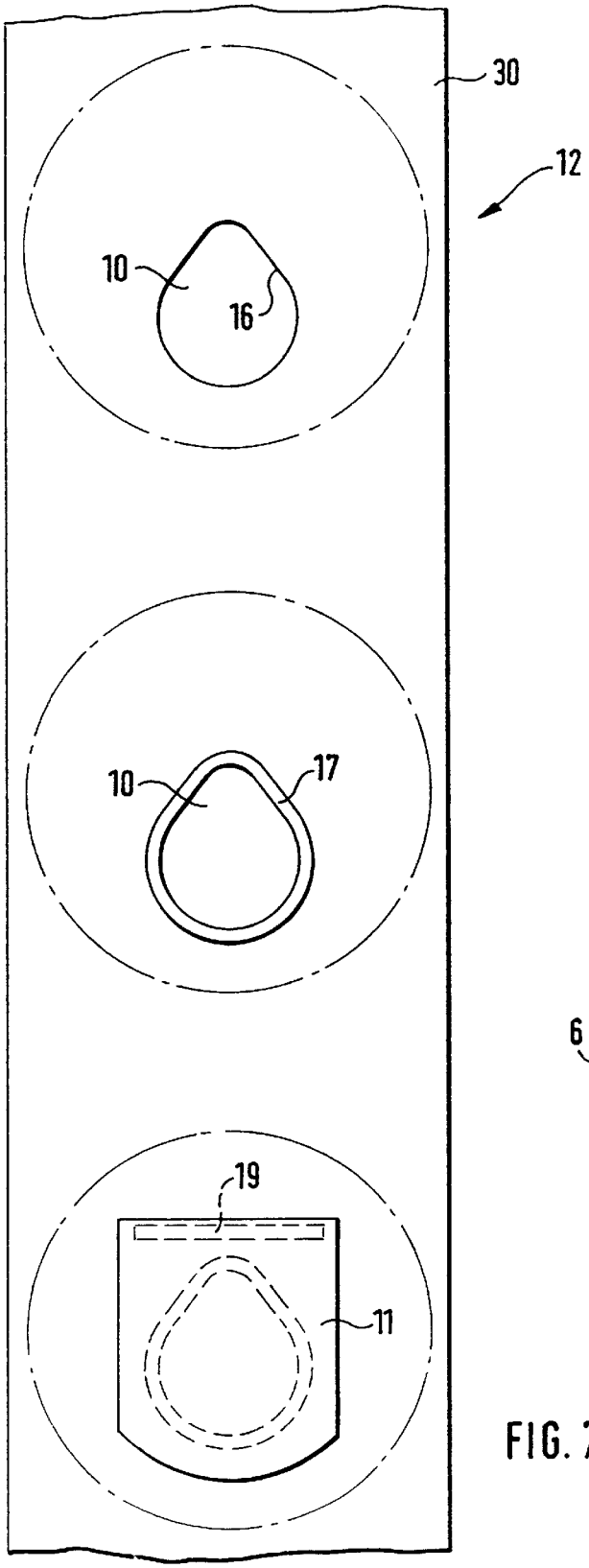
FIG. 7 is a tape of packing material for making blanks for the lid of the paper can of FIG. 1.
Figure 8:
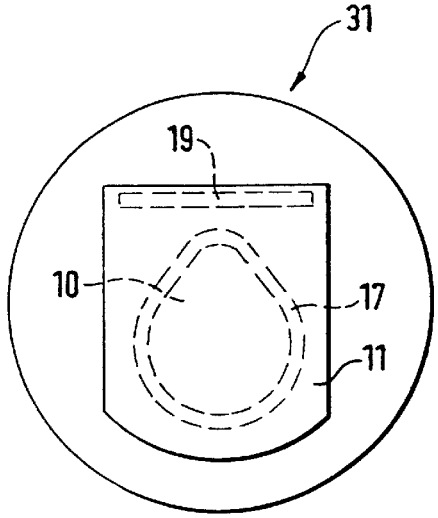
FIG. 8 is a blank for the lid separated from the tape of FIG. 7.
Figure 9:
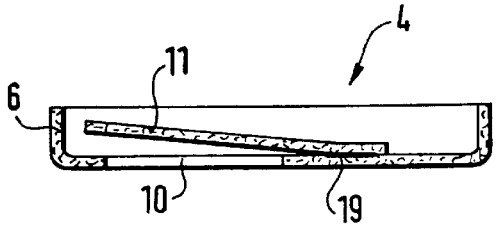
FIG. 9 is the blank of FIG. 8 formed into a lid.

The lid 4 is made of packing material 12 which is fed in the form of a tape 30 (as seen in FIG. 7). A circular blank 31 (see also FIG. 8) is punched out of the tape 30 and is formed into the lid 4 as shown in FIG. 9. The blanks 31 punched out of the tape 30 are denoted in FIG. 7 by a circular dot-dash line.

As can be seen from the upper section of FIG. 7, the tape 30 is already provided with the filling opening 10 for the lid 4 in the area of the unpunched blank 31. The cut edge 16 of the filling opening 10 is not yet covered. In a later processing stage (see also the central section of FIG. 7), the filling opening 10 is provided with the rivet-like sealing lip 17 which serves as an edge protector. In a yet later processing stage (see the lower section of FIG. 7), the pull tab 11 is adhered beside the filling opening 10 on the tape 30. Adhering takes place only in the area of a fixing point 19, preferably by heat sealing. Adherence is thus limited to a localized point and permits the pull tab 11 to be moved away from the filling opening 10. The filling opening 10 can thus be uncovered for filling.

The blank 31 (see also FIG. 8) comprising the rivet-like sealing lip 17 and the pull tab 11 is now punched out of the tape 30. The blank 31 is subsequently formed so that it obtains the form shown in FIG. 9 where the cover strip 11 is disposed outside of the fixing point 19 a small distance from the filling opening 10.

Figure 10:
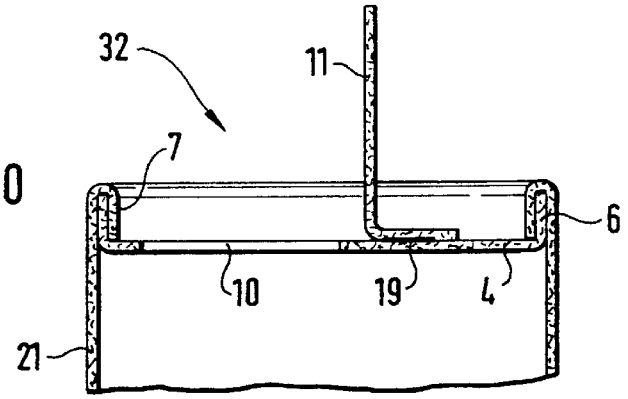
FIG. 10 is a partly completed paper can consisting of the sleeve and the lid comprising an uncovered filling opening.

The lid 4 is now inserted into one of the open front ends of the tube 21 (as best seen in FIGS. 6 and 9), where the rim 6 faces outwards. The end area 7 of the tube 21 is subsequently rolled around the rim 6. The tube 21 and the lid 4 are connected together by heat sealing. A partially completed paper can 32 has now been made as shown in FIG. 10 where that position, the pull tab 11 has been moved away from the lid 4 outside of the fixing point 19, so that the filling opening 10 is uncovered.

Figure 2:
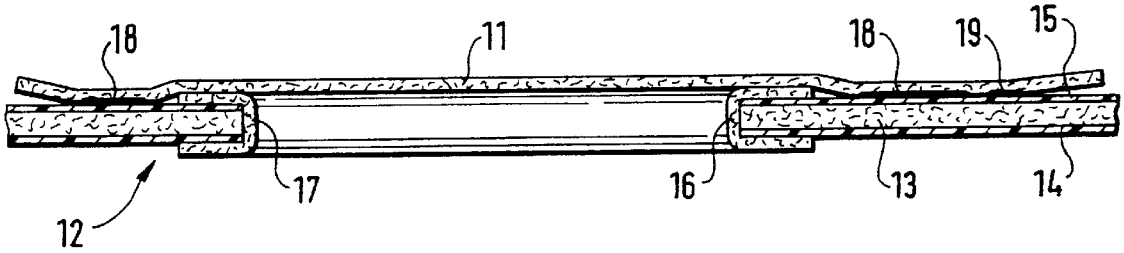
FIG. 2 is an enlarged view of the lid of the paper can of FIG. 1.
Figure 11:
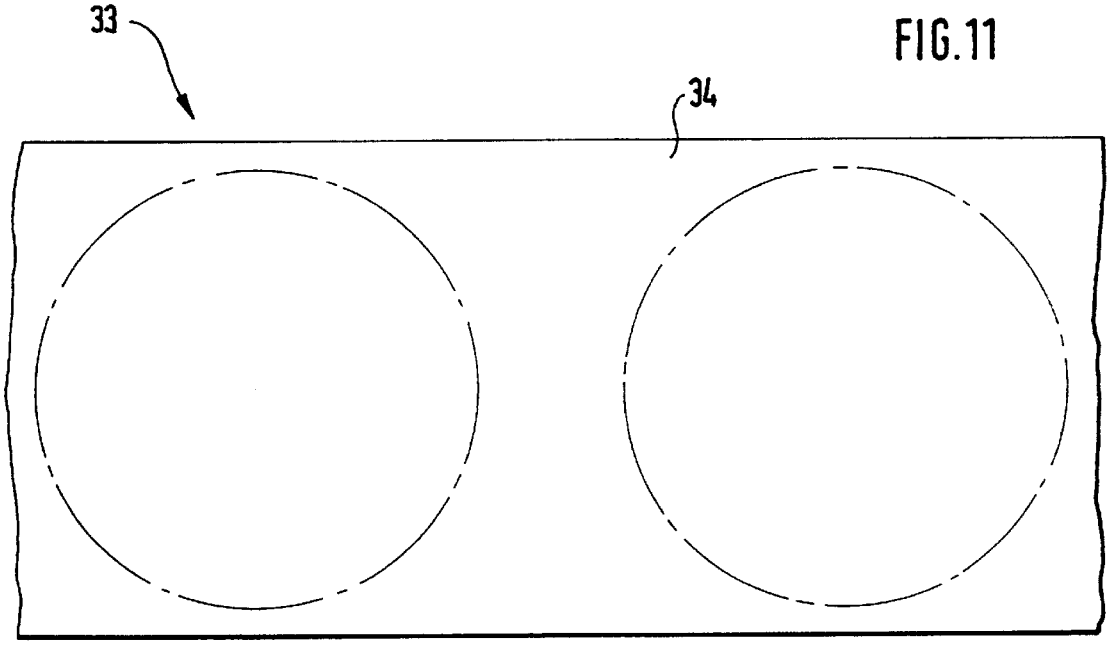
FIG. 11 is a tape of packing material for making blanks for the bottom of the paper can of FIG. 1.
Figure 12:
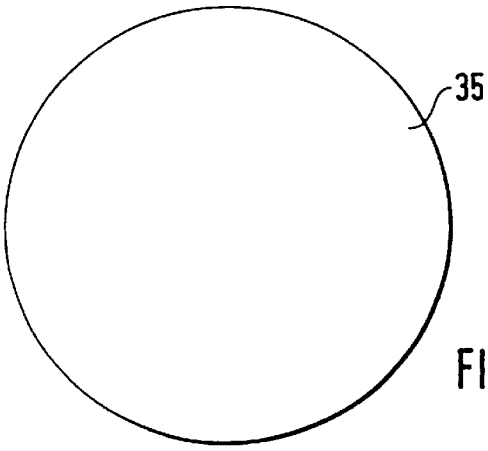
FIG. 12 is a blank for the bottom separated from the tape of FIG. 11.
Figure 13:
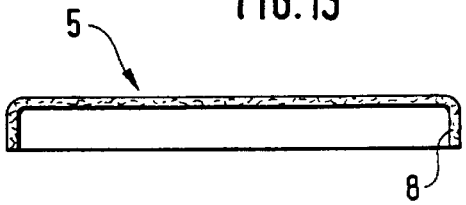
FIG. 13 is the blank of FIG. 12 formed into a bottom.

The packing material 33 (shown in FIG. 11) for making the bottom 5 has the same or similar composition as the packing material 12 of the lid 4 (shown in FIG. 2). The packing material 33 is fed in the form of a tape 34, out of which circular blanks 35 for the bottom 5 are punched as seen in FIG. 12. After the punching process, the blank 35 is formed so that it reaches its final form as shown in FIG. 13.

The bottom 5 is now inserted into the second, still open front end of the tube 21 (as shown in FIG. 6) and adhered in the same way as the lid 4. The paper can 1 is now completed and has the form shown in FIG. 1, whereby, however, the pull tab 11 is not closed. The open paper can 1 can now be fed to a filling machine for filling and sealing. There the paper can 1 can be filled through the filling opening 10. The pull tab 11 can subsequently be laid over the filling opening 10 and the heat sealed seam 18 produced. The pull tab 11 then covers and seals the filling opening 10.

In another embodiment of the present invention, the paper can may be provided with two openings. One such opening takes the form of a filling opening, and the other such opening takes the form of an emptying opening. The emptying opening can be immediately sealed closed, for example by a cover strip. A localized limited fixing of the cover strip for the opening serving only to empty is unnecessary. The emptying opening and the pull tab closing same can have the same form as for the filling opening 10 described above. The filling opening and the closing element for the filling opening can be constructed in a simpler way. Both openings can comprise an edge protector.

The manufacture of the paper can 1 does not absolutely require that all procedural stages are executed by the arrangement according to the present invention. For example, packing material for the sleeve which is already provided with an edge protector can be fed as well as packing material for the lid on which a sealing lip serving as an edge protector or a cover strip is already provided. With an additional opening, the fed packing material for the relevant container wall can already provided with an edge protector for the opening or with a cover strip. The procedural stages necessary for the application of the edge protector or the cover strip can be transferred to the supplier of the packing material.

In yet another embodiment of the present invention the sealing lip or the cover strip need not be previously applied to the tape from which the blanks for the lids are made. That is, sealing lip or the cover strip can also be applied after the blank has been punched out or it may be applied after the lid has been inserted in the tube.

The paper can 1 can be produced in the arrangement shown in FIG. 14. The manufacturing process is described below first in general and then in more detail. The blanks 24, 31, 35 fed to the arrangement 2 are put together and formed in various stages.

The arrangement 2 comprises a first star wheel 37 and a second star wheel 38 which are provided with respective mounting devices 39, 40. The two star wheels 37, 38 are connected by a transport device 41. Processing stations 42 to 51 are arranged along the periphery of the first star wheel 37, and processing stations 52 to 58 are arranged along the periphery of the second star wheel 38. The first star wheel 37 is sequentially rotatable in the direction of arrow A, while the second star wheel 38 sequentially rotates with the same motions but in the opposite direction in the direction of arrow B. The mounting devices 39 of the first star wheel 37 are thus arranged to the processing stations 42 to 51 in sequence, while the mounting devices 40 of the second star wheel 38 are arranged in sequence to the processing stations 52 to 58. In addition, the mounting devices 39 and 40 can each be arranged to the transport device 41.

Both star wheels 37, 38 are mounted to a joint machine frame 60. A material supply store 61 is arranged upstream of the machine frame 60, and a collecting container 62 for paper cans 1 is arranged downstream thereof. Packing material 22 for the sleeve 3 and packing material 12 for the lid 4 from the material supply store 61 are fed to the first star wheel 37. The fed packing material 12, 22 is processed at the processing stations 42 to 51 into the partly completed paper can 32 as shown in FIG. 10.

The partly completed can 32 is transferred from the first star wheel 37 to the second star wheel 38 by the transport device 41. Packing material 33 for the bottom 5 is fed from the material supply store 61 to the second star wheel 38. The fed packing material 33 is further processed with the partly completed paper can 32 by the processing stations 52 to 58 of the second star wheel 38 into a completed paper can 1. The completed paper can 1 reaches the collecting container 62 and can be further transported by a transport belt 63, for example to a filling installation.

The individual components of the arrangement 2 for manufacturing a paper can 1 as shown in FIG. 14 are now described. The machine frame 60 comprises a frame which is supported by feet 64, 65 on the floor. The two star wheels 37, 38 are held at a vertically arranged, central wall 66 and are arranged so that a way that their respective rotational axles 67, 68 extend horizontally. The mandrel-shaped mounting devices 39 of the first star wheel 37 and the mounting devices 40 in the form of take-up tubes of the second star wheel 38 are disposed in the same plane. The two star wheels 37, 38, the processing stations 42 to 58 arranged with respect thereto and the transport device 41 are disposed, from the viewer's standpoint, on the front side of the machine frame 60. They are arranged adjacent one another but spaced a short distance.

In the area of the transport device 41, a holding device 39 of the first star wheel 37 and a holding device 40 of the second star wheel 38 are disposed directly opposite each other so that their longitudinal axes are aligned. Thereby, a partly completed paper can 32 can be transferred in a linear movement from the first star wheel 37 to the second star wheel 38.

Both star wheels 37 and 38 are set in the same cyclical motion by a joint drive, but at different rotational angles. The drive is diverted from an electric motor 72 with which both star wheels 37, 38 are connected via a stepping motor, toothed belts and the like. The drive and gear elements of the arrangement 2 are supported by the central wall 66 and arranged on the back side of the central wall 66 in a generally known manner and thus are not shown in FIG. 14.

All the packing material required for the manufacture of the paper can 1 is fed by the joint material supply store 61 to the arrangement 2. This includes the packing material 12, 22, 33 for the lid 4, the sleeve 3 and the bottom 5 of the paper can 1. In addition, packing material 73 for the sealing strip 26 (FIG. 5), packing material 74 for the sealing lip 17 (FIG. 7) as well as packing material 75 for the pull tab 11 (FIG. 7) is fed by the material supply store 61 to form a joint material supply store 61 for all the packing material 12, 22, 33, 73, 74, 75.

The packing material 73, 74 and 75 are fed to the machine frame 60 in the form of tapes 76,77 and 78. The packing material 12, 22, 33, 73, 74, 75 fed in tapes 23, 30, 34, 76, 77, 78 is wound onto rollers 80 to 85 in the joint material supply store 61.

The packing material 22 rolled onto the roller 81 for the sleeve 3 is fed first in the form of a tape 23 to a punching device 86, where individual blanks 24 (FIG. 4) are separated off. The individual blanks 24 then reach a device 87, in which the longitudinal edges 25, 27, which form the subsequent seam area 28 (FIG. 6), are heated by hot air. In a downstream arrangement 88, a sealing strip 26 (FIG. 5) is separated off from the packing material 73 and adhered to the blank 24.

In a device 89 arranged downstream, the blank 24 is heated again in the area of the longitudinal edges 25, 27. The processing station 42 arranged downstream, serves as a feeding device for the packing material 22 and finally transports the blank 24 to a holding device 39 of the first star wheel 37.

The packing material 12 for the lid 4 is unrolled from the roller 85 in the form of a tape 30 comprising filling openings 10 and is fed first to a processing station 92, in which the sealing lip 17 (FIG. 7) is applied. The packing material 74 for the sealing lip 17 is unrolled in a corresponding way from the roller 84 and is fed in the form of a tape 77 to a processing station 92. There a blank is separated off from the tape 77, fed to the filling opening 10 and formed into the sealing lip 17.

The processing station 92 is constructed so that when the blank, separated off from the tape 77, is formed, the rivet-shape of the sealing lip 17 as shown in FIG. 2 is obtained. In the processing station 92, or alternatively in a processing station arranged downstream, the plastic sealing lip 17 is adhered to the plastic layers 14, 15 of the lid. This occurs, as already mentioned above, by heat sealing.

The tape 30, provided with a sealing lip 17 in the area of each filling opening 10, is fed to a processing station 93, in which the pull tab 11 is adhered. The packing material 75 of the pull tab 11 is unrolled from the roller 83 in the form of a tape 78 and fed to a processing station 93. There a blank is separated from the tape 78 and affixed in the form of a pull tab 11 in the area of the fixing point 19 (FIG. 7). As the processing station 93 effects only a localized affixation of the pull tab 11, the filling opening 10 can be uncovered.

The tape 30 is fed then to the processing station 45, in which the blank 31 is punched out of the tape 30 as in FIG. 7, formed into the lid 4 as in FIG. 9 and fed to the holding device 39. The processing station 45 thus serves as a feeding device for feeding the packing material 12 to the star wheel 37.

The packing material 33 for the bottom 5 is unrolled from the roll 80 and fed in the form of a tape 34 to the processing station 52 of the second star wheel 38. A blank 35 as in FIG. 12 is punched out of the tape 34, formed into the bottom 5 shown in FIG. 13 and fed to a holding device 40. The processing station 52 serves thus as a feed device for feeding the packing material 33 to the star wheel 38.

In the manufacture of the paper can 1, the blank 24 for the sleeve 3 is fed by the holding device 39 from the processing station 42 to the processing station 43 and then to processing station 44.

Here the blank 24 is formed into the tube 21 as shown in FIG. 6 and subsequently forms the sleeve 3, whereby the seam area 28 is also formed. The lid 4 is set into the tube 21 at the processing station 45 arranged downstream in rotational direction A. At the processing stations 46, 47, the rim 6 of the lid 4 and the end area 7 of the tube 21 are heated. The end area 7 is rolled in around the rim 6 in the processing station 48. The end area 7 and the rim 6 are pressed together in processing stations 49, 50. In the processing station 51, the cover strip 11 is moved away from the filling opening 10 to the position shown in FIG. 10.

By rotating the first star wheel 37 in arrow direction A by a further sequence step, the holding device 39 with the partly completed paper can 32 reaches the area of the transporting device 41. The partly completed paper can 32 is transferred in a straight line to a holding device 40 of the second star wheel 38, which holding device 40 is disposed directly opposite the holding device 39. The partly completed paper can 32 is clasped by the holding device 40 and transported to the area of the processing station 52 by a further sequential rotation of the second star wheel 38. A bottom 5 is then inserted into the still open front opening of the partly completed paper can 32. A known machine tool, spread out umbrella-like and inserted through the filling opening 10, serves as a counter-holder.

The end area 9 as shown in FIGS. 1 and 6 and the rim 8 as shown in FIG. 13 are heated in the processing stations 53, 54. The end area 9 is rolled around the rim 8 in the processing station 55. In the processing stations 56, 57, the rim 8 and the end area 9 rolled around thereof are pressed together. In the processing station 58, the completed paper can 1 is pushed away from the holding device 40 and reaches the collecting container 62 by way of a chute 95. The collecting container 62 takes the form of a drop shaft and has a capacity for around 500 to 1000 completed paper cans 1. The joint material supply store 61 is housed in a case 96 which is closed by a lid 97.

Figure 15:
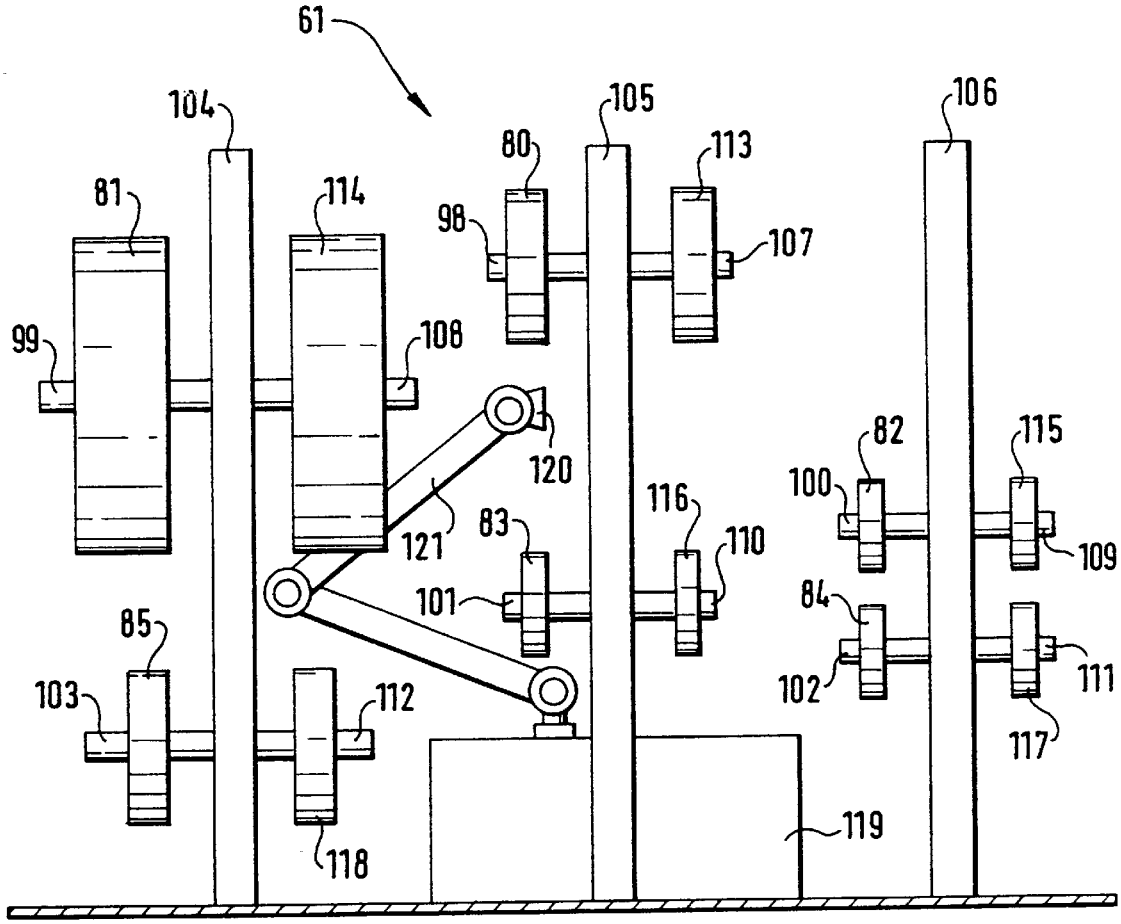
FIG. 15 is a view of a connecting device for packing material in the arrangement of FIG. 14.

As seen in FIG. 15, the rolls 80 to 85 are arranged on peg-like holders 98 to 103 which project laterally from respectively holder frames 104 to 106. Arranged at each of the holders 98 to 103 are respective adjacent holders 107 to 112 which project from the holder frames 104 to 106 towards the other side and which serve to take up reserve rolls 113 to 118. The rolls 80 to 85 and the reserve rolls 113 to 118 are not all equally wide. In the illustrated embodiment, the holders 98 to 103 or 107 to 112 are arranged laterally out-of-line to each other. In another embodiment, they can be arranged adjacently or one behind the other.

The material supply store 61 comprises a connecting device 119, by way of which the end of a roll 80 to 85 can be connected to the start of a reserve roll 113 to 118. For this purpose, the connecting device 119 comprises a connecting machine tool 120, which is affixed to a movable arm 121 and which can be moved to the rolls 80 to 85 and the reserve rolls 113 to 118. The connecting tool 120 can be applied to rolls 80 to 85 or reserve rolls 113 to 118 of varying widths.

The above described arrangement 2 is only one of many possible embodiments of the invention. It is possible to omit individual processing stations or to construct them differently. If, for example, another form of edge protector instead of the rivet-shaped one is wanted for the emptying opening 10, a differently constructed processing station is provided instead of the processing station 92.

If the packing material is to be provided beforehand with an edge protector, the processing station 88 is omitted. Also omitted are the holders 100 and 109 as well as the rolls 82 and 115 of the packing material 73. If the packing material for the lid is to be provided beforehand with an edge protector for the emptying opening, the processing station 92 is omitted. Also omitted are the holders 102 and 111 as well as the rolls 84 and 117 of the packing material 74.

When the packing material for the lid is to be provided beforehand with a pull tab, the processing station 93 is omitted. Also omitted are the holders 101 and 110 as well as the rolls 83 and 116 of the packing material 75. The processing station 93 for applying the covering strip 11 could be arranged at another place, for example in the area of the circumference of the first star wheel 37.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An arrangement for manufacturing a paper container from blanks of material, comprising a first transport wheel having a horizontally extending first rotational axis, and a second transport wheel arranged adjacent the first transport wheel and having a horizontally extending second rotational axis, and processing stations operatively arranged with respect to the first and second transport wheels, the processing stations associated with the first transport wheel being configured to heat an end area of a sleeve formed with a seam from a blank and into which sleeve a lid is set and being further configured to heat a rim of the lid and an associated end area of the sleeve and to press together an end area of the sleeve and the rim, and the processing stations associated with the second transport wheel being configured to assemble a bottom into the sleeve, and to heat and press together the bottom and the sleeve, wherein the transport wheels and the processing stations are operatively arranged on one side of a vertically disposed central wall of a joint machine frame, and driving elements for the transport wheels are arranged on an exposed side of the vertically disposed central wall opposite from the one side on which the transport wheels and processing stations are disposed for easy accessibility.

2. The arrangement according to claim 1, wherein a joint material supply store is operatively associated with the processing stations and comprises at least one holder which holds each roll of packing material.

3. The arrangement according to claim 2, wherein reserve holders for holding a reserve roll are operatively associated with the at least one holder.

4. The arrangement according to claim 3, wherein a connecting device for connecting an end of a roll with the beginning of a reserve roll is arranged at the joint material supply store.

5. The arrangement according to claim 4, wherein the connecting device is configured to handle rolls of varying widths.

6. The arrangement according to claim 2, wherein the joint material supply store comprises respectively a holder for a roll of packing material for a sleeve, for a roll of packing material for a bottom and for a roll of packing material for a lid of a paper can.

7. The arrangement according to claim 6, wherein reserve holders for holding a reserve roll are arranged at the holders.

8. The arrangement according to claim 2, wherein the joint material supply store comprises a holder for a roll of packing material for a pull tab which is configured to cover the filling opening of a paper can to be manufactured.

9. The arrangement according to claim 8, wherein the joint material supply store comprises respectively a holder for a roll of packing material for a sleeve, for a roll of packing material for a bottom and for a roll of packing material for a lid of a paper can.

10. The arrangement according to claim 1, further comprising a transport device, for linearly transporting a partly completed paper container from the first transport wheel to the second transport wheel.

11. The arrangement according to claim 10, wherein the transport wheels are arranged such that, in an area of the transport device, a holding device of the first transport wheel is disposed directly opposite a holding device of the second transport wheel.

12. The arrangement according to claim 1, wherein the first transport wheel is operatively arranged at a processing station for forming a sleeve, a processing station for applying a lid having a filling opening, and a processing station for localized limited affixing of a pull tab on the material for the lid, and a working station for applying the bottom is arranged to the second transport wheel.

13. The arrangement according to claim 12, wherein a processing station for moving away the pull tab from the filling opening is operatively arranged with respect to the firs transport wheel and is operatively arranged downstream of the processing station for localized limited affixing of a pull tab.

14. The arrangement according to claim 12, wherein a processing station for affixing a sealing lip to a filling opening of the paper can to be manufactured is operatively arranged with respect to the first transport wheel.

15. The arrangement according to claim 14, wherein a processing station for moving away the pull tab from the filling opening is operatively arranged with respect to the first transport wheel and is operatively arranged downstream of the processing station for localized limited affixing of a pull tab.

16. The arrangement according to claim 14, wherein the processing station is operatively configured to form the packing material into a rivet-shape sealing lip.

* * * * *